United States Patent [19]

Whorton, III et al.

[11] 4,323,171

[45] Apr. 6, 1982

[54] BEVERAGE DISPENSING DEVICE AND CONTAINER THEREFOR

[75] Inventors: Robert B. Whorton, III, Spartanburg, S.C.; Samuel C. Crosby, Jr., Decatur, Ga.; Frank M. Iannelli, Spartanburg, S.C.; James Denmark, Ilkley; Edward L. Jeans, Hereford, both of England

[73] Assignee: Tannetics, Inc., Erie, Pa.

[21] Appl. No.: 54,304

[22] Filed: Jul. 2, 1979

[51] Int. Cl.[3] ..... B67D 5/54; B67D 5/56

[52] U.S. Cl. ..... 222/82; 222/83.5; 222/86; 222/88; 222/180; 222/325; 222/400.7; 222/464; 222/465 R

[58] Field of Search ..... 222/81, 82–83, 222/83.5, 85–86, 88–90, 180, 325, 400.7, 394, 541, 464, 465; 248/318

[56] References Cited

U.S. PATENT DOCUMENTS

| | | | |
|---|---|---|---|
| 2,361,705 | 10/1944 | Patterson | 222/82 X |
| 2,815,885 | 12/1957 | Haas | 222/82 |
| 3,398,427 | 8/1968 | John | 222/464 X |
| 3,685,694 | 8/1972 | Ianelli | 222/82 |
| 3,853,478 | 12/1974 | Rodgers | 222/85 X |
| 3,885,742 | 5/1975 | Menzel | 222/89 X |

FOREIGN PATENT DOCUMENTS

| | | | |
|---|---|---|---|
| 120476 | 10/1945 | Australia | 222/541 |
| 890169 | 9/1953 | Fed. Rep. of Germany | 222/83.5 |

*Primary Examiner*—Charles A. Marmor

*Attorney, Agent, or Firm*—Bailey, Dority & Flint

[57] ABSTRACT

A liquid container having easy penetratable wall portions provided in laterally extending hollow lobes or protuberances which communicate with the interior of the container. The container is impaled upon piercing pins positioned in sockets carried in a beverage dispensing device. The lateral protuberances serve as suspension elements for supporting the container and also provide surfaces through which piercing pins supply pressurized gas to the container and remove liquid syrup from the container for mixing with a carbonated liquid.

9 Claims, 29 Drawing Figures

Fig. 7.
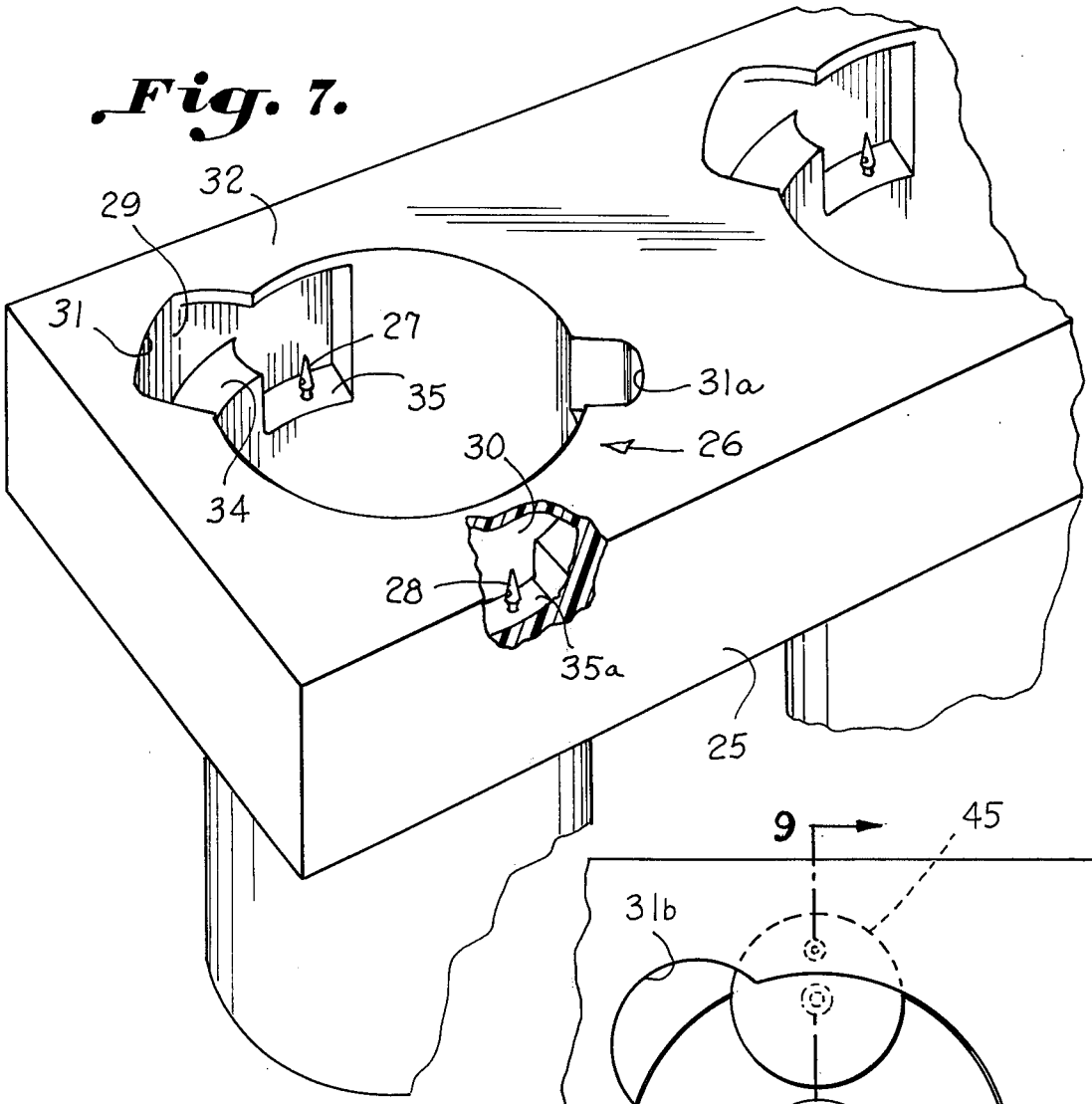
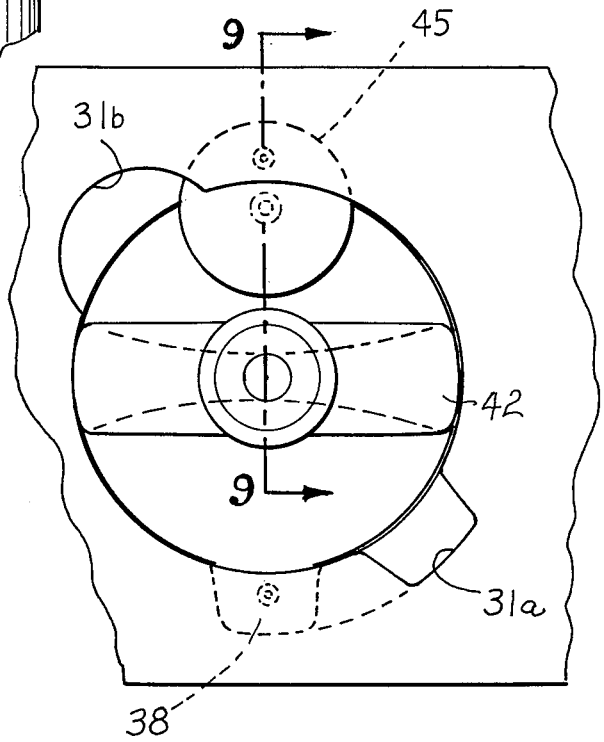
Fig. 8.
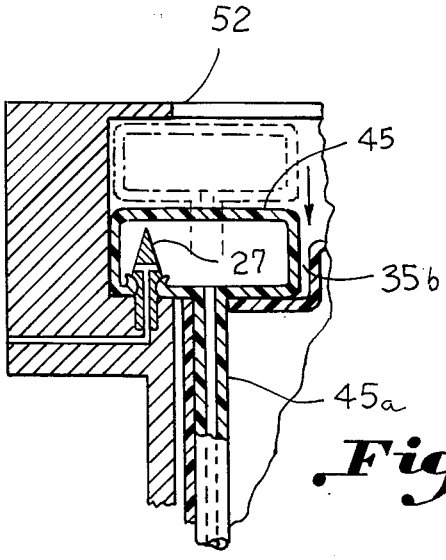
Fig. 9.

BEVERAGE DISPENSING DEVICE AND CONTAINER THEREFOR

BACKGROUND OF THE INVENTION

Heretofore, carbonated drinks for home consumption have normally been purchased in bottles after carbonated water and syrup have been mixed in a large tank and the mixture inserted into the bottles. This procedure of supplying drinks for consumption is quite expensive since the majority of a carbonated drink is water. As a result, each bottle contains only a relatively few drinks. The cost of the bottle and the expense in delivering the large volume of water contained in each drink adds substantial expense to each individual drink.

In an attempt to reduce the overall cost per drink, bars, restaurants, and other similar establishments utilize postmixed beverage dispensing systems wherein syrup from large containers is mixed at the establishment with carbonated water for producing drinks. While the large volume or commercial postmixed beverage dispensing systems have worked satisfactorily in establishments that have a high drink volume, they are not practical for in-home use or in use in establishments which have a relatively low volume of drink consumption. The commercial beverage dispensing devices are quite expensive utilizing relatively large carbon dioxide bottles and syrup containers making it quite impractical to utilize in low volume establishments such as homes. Furthermore, the syrup container utilized in the commercial postmixed beverage dispensing equipment require mechanical couplings to be engaged and disengaged when inserting and removing the syrup container therefrom.

In U.S. Pat. No. 3,685,694 granted to Frank M. Iannelli on Aug. 22, 1972 an attempt was made to provide a syrup container which is pierced by piercing pins upon insertion of the container in a receptacle. One of the piercing pins is connected to a $CO_2$ line which is used for pressurizing the container and another piercing pin provides an outlet for the liquid from the container. Upon opening of a valve for dispensing a carbonated drink from the equipment, carbon dioxide gas previously introduced into the sealed container through the $CO_2$ pin, forces liquid syrup to a mixing head, where it is mixed with the carbonated water which is simultaneously supplied to the mixing head. One problem with the device shown in U.S. Pat. No. 3,685,694 is that the pin for the carbon dioxide gas is normally below the liquid level of the syrup. As a result, when the carbon dioxide tank becomes exhausted, the syrup tends to flow back through the $CO_2$ piercing pin into the $CO_2$ line. This, of course, contaminates the $CO_2$ line. In order to prevent the backflow of syrup into the $CO_2$ line a check valve has been utilized in the line, however, the syrup coming into contact with the check valve frequently fouls the check valve causing malfunctions.

SUMMARY OF THE INVENTION

The invention relates to a syrup container and a beverage dispensing apparatus. The container is constructed of easy penetratable plastic material and has at least one hollow lateral protuberance extending outwardly from a wall thereof. The lateral protuberance serves as a suspension means supporting the container in a suspended position in a receptacle provided in the beverage dispensing device.

An arcuate channel is carried adjacent a top portion of the receptacle and in one particular embodiment a pair of sockets are carried adjacent the end of the arcuate channel. Piercing pins are carried within the sockets for piercing the lobes carried on the container after the container has been inserted into the receptacle.

One of the lobes is located adjacent the top of the container and communicates with the interior of the container through a feed tube which extends from the lobe to the bottom of the container.

In one particular embodiment, the container is blow molded and the feed tube is formed during the molding operation by pinching a portion of the container to isolate the interior of the container from the feed tube except at the bottom thereof.

Accordingly, it is an object of the invention to provide a container that can be readily inserted in a beverage dispensing device and automatically connected to a carbon dioxide piercing pin and a piercing pin for removing syrup from the container.

Another important object of the invention is to provide a container which has lobes thereon through which communication with the interior of the container is made and which also serve as means for suspending the container within a beverage dispensing device.

Another important object of the present invention is to provide a beverage dispensing device from which containers can be readily removed and inserted therein without mechanical couplings.

Still another important object of the present invention is to provide a beverage dispensing device which accommodates containers of syrups of different flavors that can be readily selected and the containers can be readily inserted and removed therefrom.

These and other objects and advantages of the invention will become apparent upon reference to the following specification, attendant claims, and drawings.

BRIEF DESCRIPTION OF THE DRAWINGS

FIG. 7 is an enlarged perspective view illustrating the top portion of a receptacle provided for the beverage dispensing device and in particular a guide channel and socket which is utilized for suspending a syrup container, FIG. 8 is a fragmentary plan view illustrating the manner in which the syrup container of FIG. 5 is inserted within a receptacle, FIG. 9 is a sectional view taken along line 9—9 of FIG. 8 showing a piercing pin piercing one of the lobes of the syrup containers.

DESCRIPTION OF A PREFERRED EMBODIMENT

Figure 1:
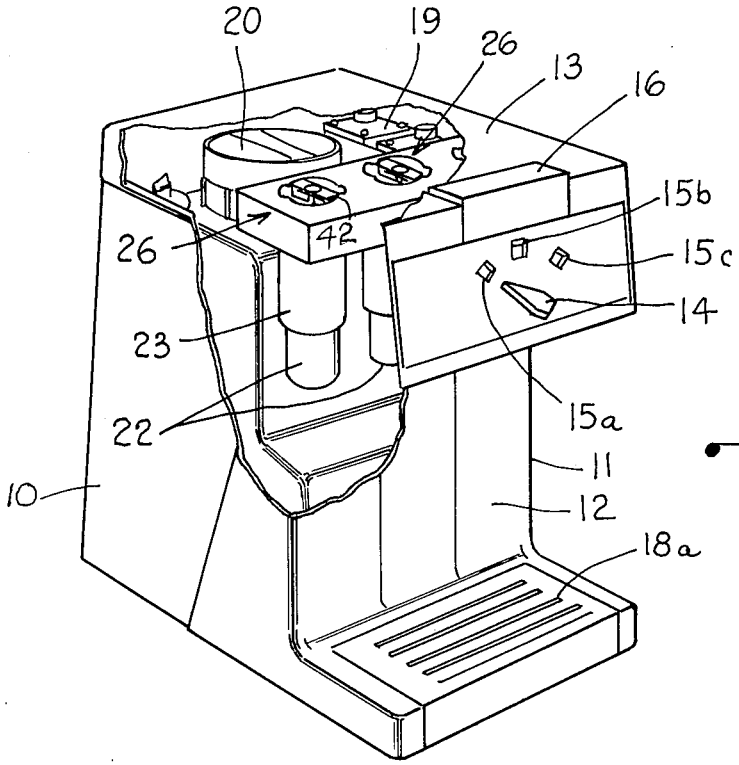
FIG. 1 is a perspective view with parts broken away to show the interior of a beverage dispensing device constructed in accordance with the present invention.

Referring in more detail to FIG. 1 of the drawings, there is illustrated a beverage dispensing device that is suitable for in-home use. The housing for the beverage dispensing device includes vertically extending side walls 10 and 11 which are joined by a front wall 12 and rear wall. A top 13 is connected by hinges (not shown) adjacent the back corners thereof so as to provide access to the interior of the housing. The front portion of the top extends forwardly beyond the front wall 12 and has a selection knob 14 positioned thereon. By rotating the selection knob to the three positions indicated by the reference characters 15*a*, 15*b* and 15*c*, different flavored drinks can be selected by the user. A pull handle 16 is carried adjacent the top front corner of the housing which activates a mixing valve 17 shown in FIG. 2, for causing a mixture of liquid syrup and carbonated water to be dispensed therefrom.

When drawing a drink, a cup is placed on top of a grate 18*a* carried on a forwardly extending member directly under the mixing valve 17. Positioned below the grate 18*a* is a cup-shaped receptacle (not shown) which collects drippings or spillage that may occur during the drawing of the drink. The entire housing may be constructed of any suitable material such as molded plastic.

Figure 2:
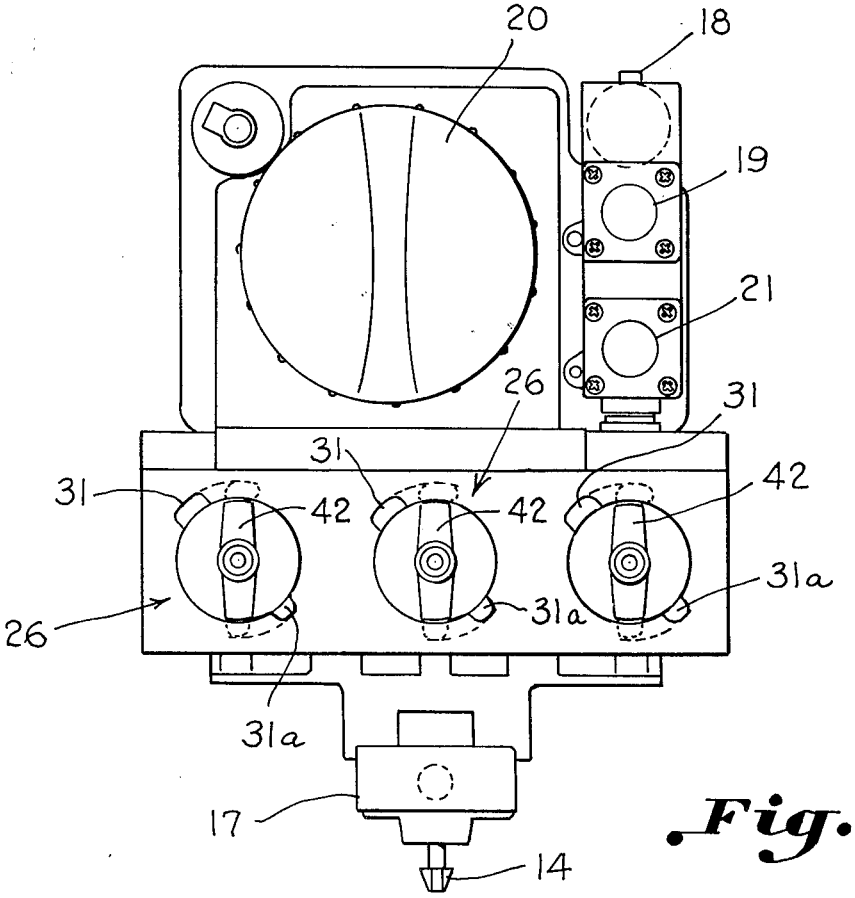
FIG. 2 is a plan view of the beverage dispensing device illustrated in FIG. 1 with the top removed therefrom.

As illustrated in FIG. 2, the beverage dispensing device includes a tank of carbon dioxide 18 which is fed through a regulating valve 19 that reduces the pressure down to approximately forty pounds. Tubes are connected from the regulating valve 19 to both a carbonating tank 20 and to another regulating valve 21. The carbon dioxide gas flows into the carbonating tank 20 through an elongated tube to a disk-shaped diffuser which causes bubbles of carbon dioxide to be expelled adjacent the bottom of the carbonating tank 20 for carbonating water carried therein.

In normal usage, the tank 20 is filled with ice and water so that the carbon dioxide bubbling through it produces carbonated water. One particular carbonating tank that can be utilized is disclosed in U.S. Pat. No. 3,578,295. The outlet of the carbonating tank 20 is fed directly to the mixing valve 17 for being mixed with one of three flavors of syrup. The mixing valve 17 may be any suitable mixing valve, and one particular suitable mixing valve is disclosed in U.S. Pat. No. 3,411,540.

As the gas flows from the carbon dioxide cylinder 18 as previously mentioned, it is first reduced by the regulator valve 19 which feeds the reduced pressure gas to the carbonating tank 20 and another reducing valve 21. The reducing valve 21 reduces the pressure further to approximately eight pounds per square inch. This reduced pressure is provided for pressurizing the syrup containers for aiding in dispensing the syrup from the containers and feeding such to the mixing valve 17.

In the particular embodiment shown in FIGS. 1 and 2, three syrup containers containing different flavored syrups are carried within receptacles 23 provided in the housing. The receptacles 23 have a substantially cylindrical lower portion through which the syrup containers 22 extend. The syrup containers 22 are loaded into the receptacles 23 from the top. Positioned adjacent the top of each of the receptacles is an elongated rectangular member 25 as best illustrated in FIGS. 1, 2 and 7, upon which heads generally designated by the reference characters 26 are carried for suspending the containers. The heads 26 are also provided for insuring positive connection between piercing pins 27 and 28 and the syrup containers. The piercing pin 27 is provided for puncturing the syrup container and delivering syrup from the container to the mixing head 17. The piercing pin 28 is, in turn, connected by conduit to the pressure reduction valve 21 for pressurizing the syrup containers with a pressure of approximately eight pounds per square inch so as to force syrup out of the syrup containers responsive to manipulating the handle 16 carried on top of the housing when drawing a drink therefrom.

The head 26 includes a pair of arcuate-shaped channels 29 and 30. The arcuate-shaped channel 29 has an opening 31 provided in an upper wall 32 positioned thereover which provides access for a lobe carried on the syrup container so that the syrup container can be lowered through the head. When the syrup container is in position the lobe rests on a bottom horizontally extending wall 34 of the arcuate-shaped member 29. Adjacent the other end of the arcuate-shaped member 29 is a socket 35 which has the piercing pin 27 positioned in the bottom thereof. A socket 35*a* and an opening 31*a* are provided on the opposite side of the head for accommodating a different size lobe provided on the container.

To insure proper positioning of the syrup containers in the head the sockets 35*a* and 35 are different sizes. As can be seen, the socket 35*a* is slightly smaller than the socket 35 and similarly the opening 31*a* is slightly smaller than the opening 31.

Figure 4:
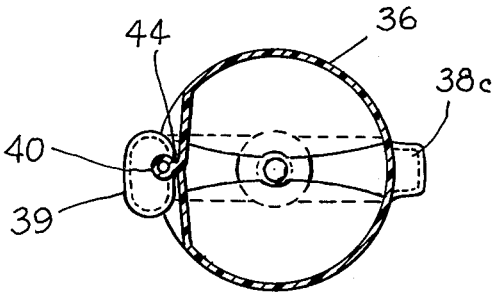
FIG. 4 is a sectional view taken along 4—4 of FIG. 3.
Figure 3:
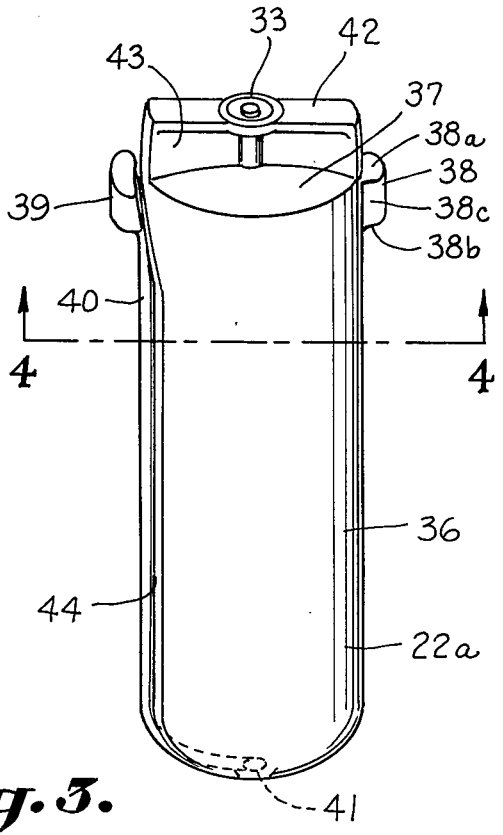
FIG. 3 is a perspective view of a syrup container constructed in accordance with the present invention.

The supporting head 26 shown in FIGS. 2 and 7, are provided for accommodating a syrup container such as illustrated in FIGS. 3 and 4.

In one particular embodiment, the syrup container is constructed of blow molded plastic material such as polyethylene, so that it is easily penetratable by the piercing pin when inserted in the receptacle. The container is substantially cylindrical in shape and is sealed and includes a vertically extending side wall 36 which is joined by a bottom wall and a top wall 37. Adjacent the top of the container 22*a* are a pair of lateral protuberances that take the form of protruding profile lobes 38 and 39. The lobe 38 has a top wall 38*a* and a bottom wall 38*b* that are joined by a side wall 38*c*. An opening is provided in the side wall 38*c* providing communication between the lobe and the interior of the container 22*a*. The lobe is constructed as previously mentioned, of plastic material that is easily penetratable by the piercing pins, however, it should be of sufficient rigidity so as to support the syrup container when suspended in the sockets provided in the head 26. The lobe 38*a* is provided for receiving the $CO_2$ piercing pin 28 so that once it is punctured with the piercing pin, carbon dioxide is fed to the top of the syrup container pressurizing the syrup container. Normally, there is an on-off valve provided between the regulator valve 21 and the piercing pin 28 which is activated after the syrup container 22*a* has been properly positioned within the receptacle.

The other lobe 39 also has top and bottom walls that are joined by a side wall. The lobe 39 has a different crosssectional shape from the lobe 38 so that it can only be inserted in the head 26 in one position insuring that the piercing pins 27 and 28 enter the correct lobe when the container is inserted in the receptacle. A tubular passage 40 extends through a side wall of the lobe 39 down along the edge of the container and into the bottom of the container 22*a* terminating in an opening 41. The purpose of the tubular passage 40 is to convey the syrup from the bottom of the container up to the lobe 39 when drawing the syrup from the container 22*a*. Normally, strengthening and stabilizing fins are molded on the bottom of the container upon which the container can sit when not being used or when being displayed for sale.

A raised member 42 is provided on the top of the container and has indented finger gripping surfaces 43 provided thereon so as to provide a gripping surface for the container.

When inserting the syrup container 22*a* in the receptacle 23, a person merely grips the container by the handle 42 and lowers the container down into the receptacle 23 making certain that the lobes 39 and 38 are in alignment with the openings 31 and 31*a*, respectively, carried in the head. After the lobes 38 and 39 pass through the openings 31 and 31*a*, they then rest on the arcuate surfaces 34 of the guide channels. The user rotates the container by twisting the handle 42 in a clockwise direction until the lobes are directly over the sockets 35 and 35*a*. Once the lobes are positioned directly over the sockets 35 and 35*a* the user presses down causing the piercing pins 27 and 28 to extend through and penetrate the bottom walls of the lobes 38 and 39 providing communication between the interior of the lobes and the pins. As the pins penetrate through the bottom walls as a result of the shape of the piercing pins the plastic bends around the piercing pins providing a seal such as best illustrated in FIG. 9.

Referring back to the syrup container 22*a* shown in FIG. 3, as previously mentioned it is normally blow molded. During the blow molding process, the mold is closed at a juncture between the tubular member 40 and the wall 36 of the syrup container producing a seal 44 between the tubular passage 40 and the side wall 36 of the receptacle. As a result, the syrup container is a single unitary molded package with the exception of a filling top 33 which is carried on top of the handle 42. The purpose of the filling top 33 is, of course, to provide access to the interior of the container when filling the container with syrup. Once the container has been filled with syrup, the filling top is placed thereon.

The container and the lobes utilized on the container can take different shapes and several modified forms of the invention are shown in the drawings and discussed more fully below. Like reference characters will be utilized for the common portions of the containers.

Figure 5:
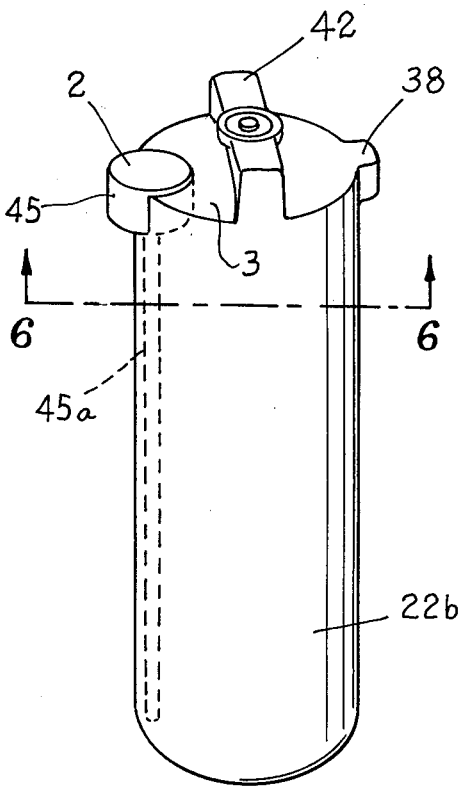
FIG. 5 is a perspective view of an alternate form of a syrup container constructed in accordance with the present invention.
Figure 6:
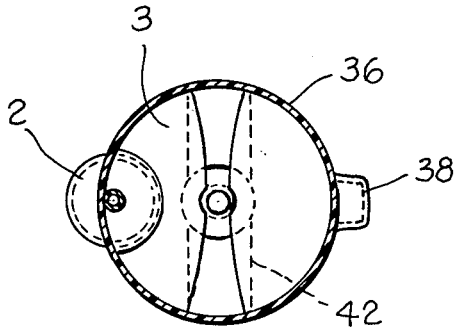
FIG. 6 is a sectional view taken along line 6—6 of FIG. 5.

The container shown in FIGS. 5, 6 and 9 is similar to the container shown in FIG. 3 with the exception of the shape of the lobe 45 through which the syrup piercing pin 27 extends. In this particular embodiment, the lobe 45 is substantially cylindrical in shape and has a tubular member 45*a* extending downwardly from a bottom wall thereof to the bottom of the container 22*b*.

An opening 31*b* corresponding in shape to lobe 45 provides access to the arcuate channel and socket 35*b* which also corresponds in cross sectional shape to lobe 45.

In FIGS. 10 through 20, there are illustrated modified forms of the invention wherein and syrup containers are inserted into the beverage dispensing device from the bottom instead of from the top as previously described.

Figure 10:
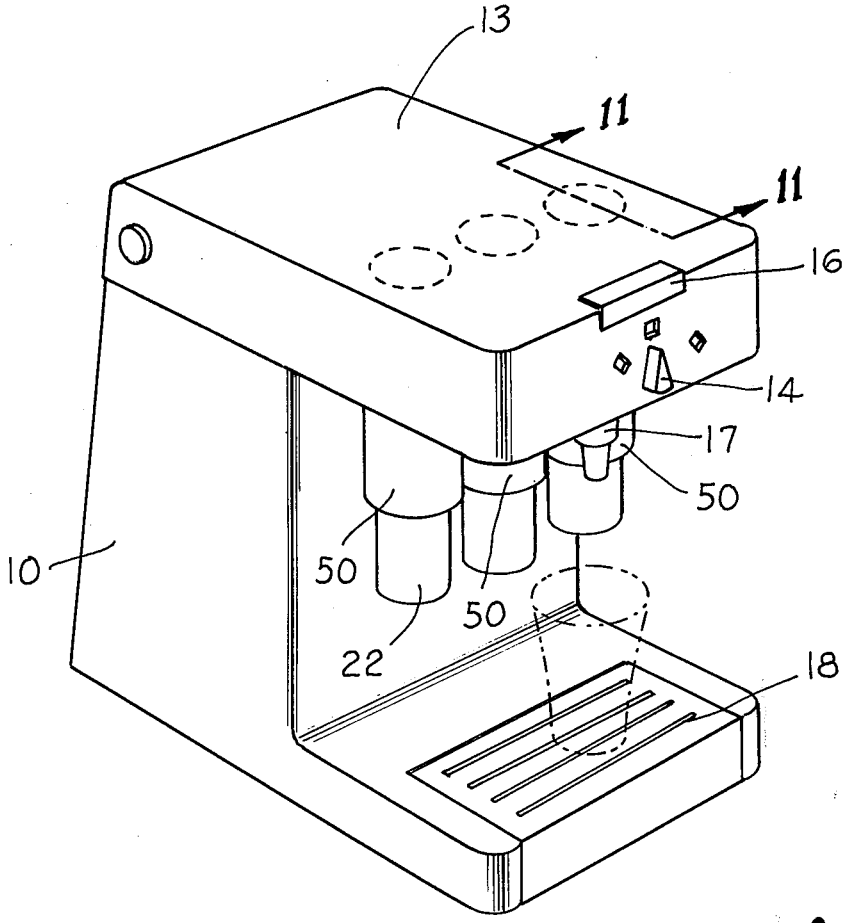
FIG. 10 is a perspective view of an alternate form of a beverage dispensing machine for dispensing carbonated beverages in an in-home application.
Figure 11:
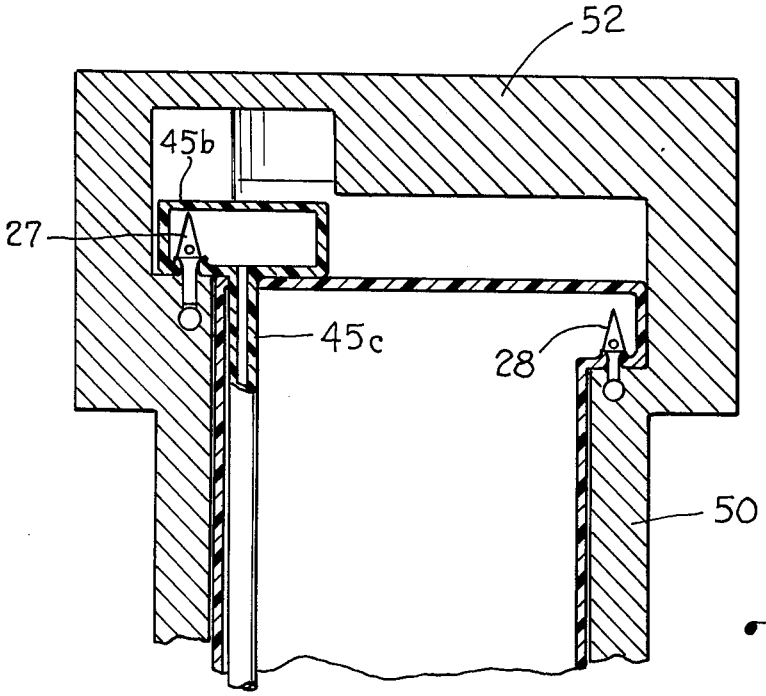
FIG. 11 is a fragmentary sectional view taken along line 11—11 of FIG. 10 illustrating a portion of a syrup container carried in said beverage dispensing device.
Figure 12:
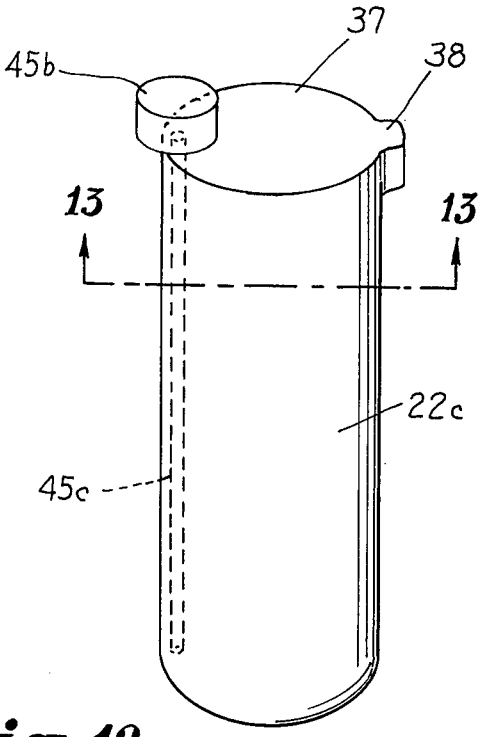
FIG. 12 is a perspective view of still another syrup container constructed in accordance with the present invention.
Figure 16:
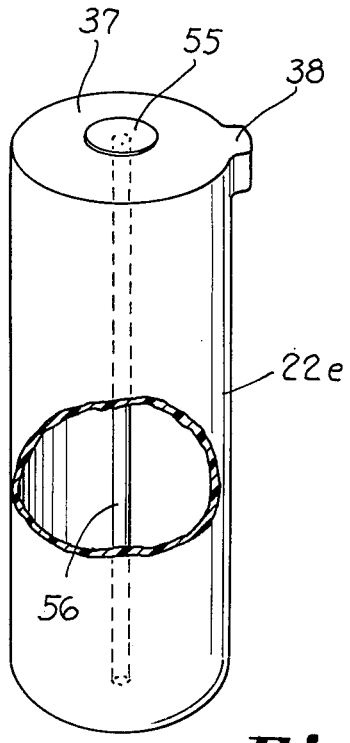
FIG. 16 is a perspective view with parts broken away to show the interior of still another alternate container constructed in accordance with the present invention.
Figure 13:
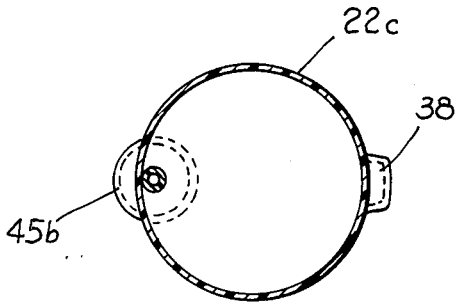
FIG. 13 is a sectional view taken along line 13—13 of FIG. 12.
Figure 17:
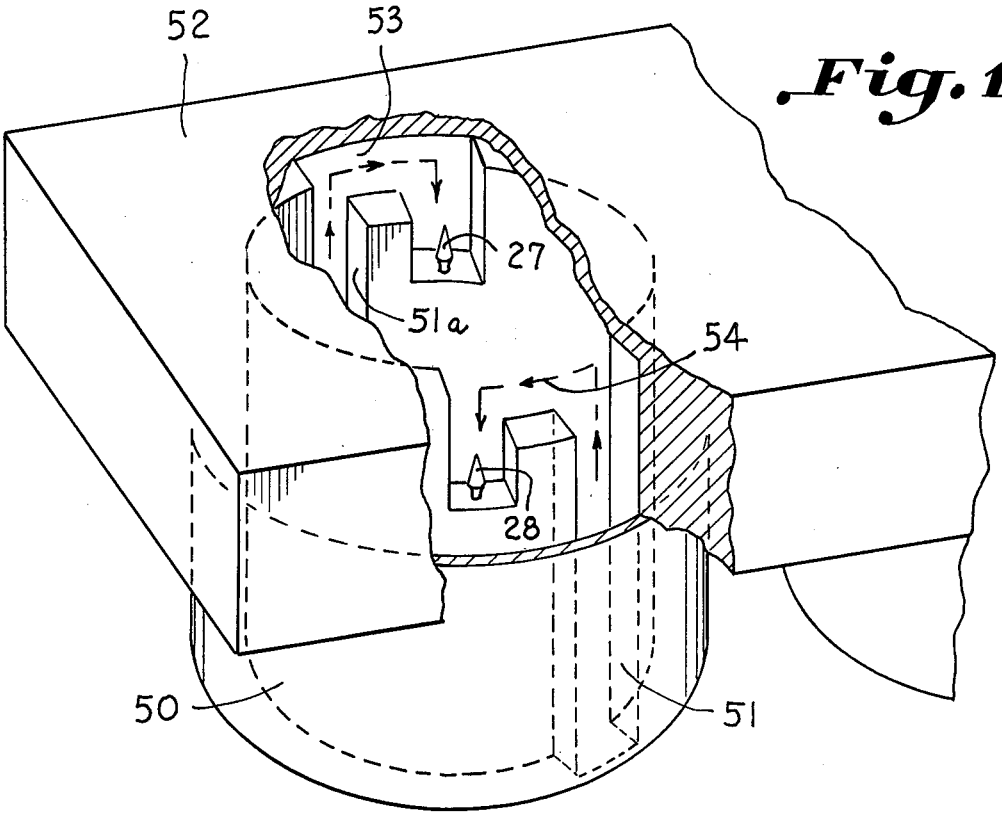
FIG. 17 is an enlarged persepctive view with parts broken away illustrating a receptacle carried in the beverage dispensing device for receiving the syrup containers.

The beverage dispensing device illustrated in FIG. 10 includes tubular receptacles 50 which extend down below the front overhanging top portion of the dispenser in which the mixing valve 17 is carried. As best illustrated in FIGS. 10, 11 and 17, the receptacles 50 include a side wall which has vertically extending slots 51 and 51*a* provided therein into which the lobes are positioned for guiding the syrup container as it is raised to the arcuate channel for insertion on the piercing pins 27 and 28. The slots 51 and 51*a* terminate below an upper rectangular solid housing 52 adjacent the guide channels 53 and 54. At the end of the guide channels 53 and 54 are sockets in which the piercing pins 27 and 28 are carried. In FIGS. 12 and 13 there is illustrated a syrup container 22*c* that is provided for being inserted in the suspending head shown in FIG. 11. This syrup container includes a cylindrical-shaped lobe 45*b* that is welded to the top 37 of the container through which the syrup is removed from the container. Extending downwardly from the cylindrical lobe 45*b* is a tube 45*c*. The piercing pins 27 and 28 pierce the lobes 45*b* and 38 in the same manner as previously described once the lobes are positioned over the sockets in which the piercing pins 27 and 28 are carried.

Figure 15:
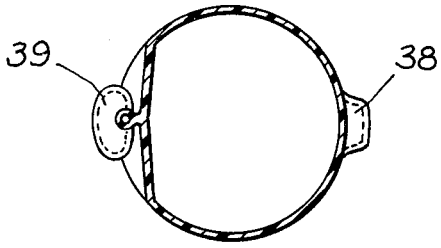
FIG. 15 is a sectional view taken along line 15—15 of FIG. 14.
Figure 14:
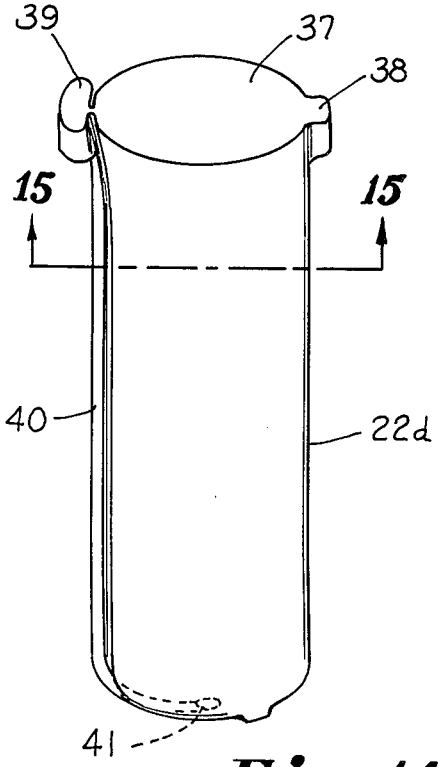
FIG. 14 is a perspective view illustrating still another alternate embodiment of the container constructed in accordance with the present invention.

In FIGS. 14 and 15 there is illustrated still another modified form of a container 22*d* which is identical to the container shown in FIG. 3 with the exception that the handle 42 is not provided on the top 37 and the top surface 37 is flat. This container shown in FIGS. 14 and 15 is provided for being loaded from the bottom of the receptacle. When loading container 22*d*, the lobes 38 and 39 are positioned in the appropriate guide slots 51 and 51*a* and raised vertically until they reach the arcuate channels. When the lobes reach the arcuate channels the syrup container 22*d* is rotated clockwise to position the lobes 38 and 39 over the piercing pins 27 and 28. The container is then pulled downwardly to cause the piercing pins to enter the lobes 38 and 39.

Figure 18:
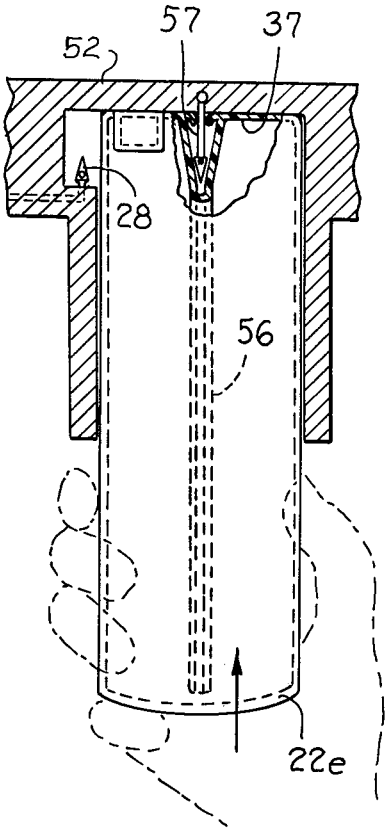
FIGS. 18, 19 and 20 illustrate the manner in which the syrup container of FIG. 16 is inserted in one particular receptacle.
Figure 19:
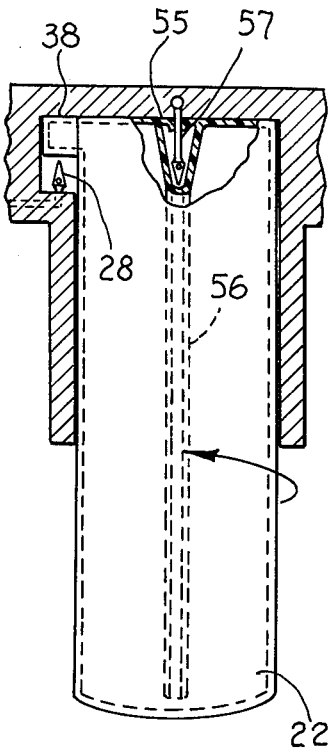
Figure 20:
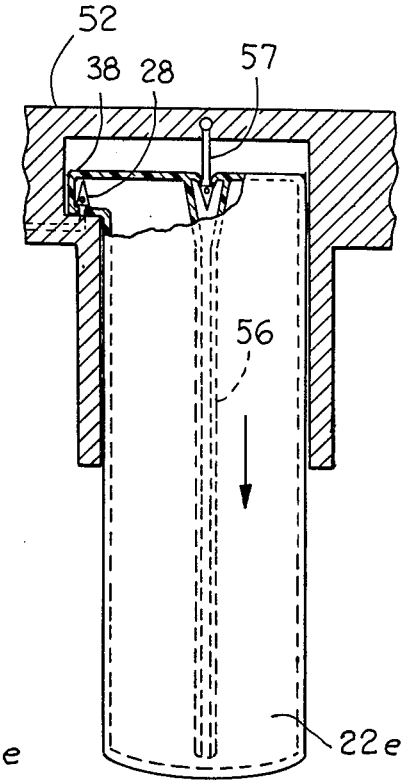

In FIGS. 16, 18, 19 and 20 there is illustrated still another container 22*e* which is provided for being loaded from the bottom of the receptacle. This container 22*e* includes the same laterally extending protuberance or lobe 38 through which the carbon dioxide piercing pin 28 extends as well as a centrally located penetratable surface 55 that is carried on the top 37 of the container. Extending downwardly from the surface 55 is a tube 56 which terminates adjacent the bottom of the syrup container. As a result of the penetratable surface 55 being centrally located in the center of the top 37, it is necessary that the syrup removable pin 57 as illustrated in FIGS. 18, 19 and 20, be centrally located in the member 52 which extends over the top of the receptacle.

Referring now to FIGS. 18, 19 and 20, the container 22*e* is inserted from the bottom with the lobe 38 aligned with one slot in a side wall 50. The container is raised until the top 37 thereof abuts against the bottom surface of the top wall 52 wherein the pin 57 penetrates through the central penetratable portion 55 providing communication with the tube 56. The container is then rotated clockwise as shown in FIG. 19 until the lobe 38 is positioned over the socket in which the pin 28 is carried.

The container is then pulled downwardly to the position shown in FIG. 20 wherein the pin 28 extends through the lobe 38 providing communication between the source of carbon dioxide and the interior of the container. It is noted that the pin 57 should have sufficient length to extend down into the tubular member 56 once the container is lowered to a position illustrated in FIG. 20.

While all of the syrup containers above discussed and shown are suspended in the sockets by hanging, it is to be understood that it is within the scope of the invention to turn the syrup containers upside down and reverse the function of the carbon dioxide lobes and the syrup lobes so that the carbon dioxide supplying pins would then penetrate the lobe which has a tube connected thereto. Since the tube would then extend to the top of the syrup container, syrup would not be permitted to flow down into that lobe and contaminate that pin associated therewith.

Figure 21:
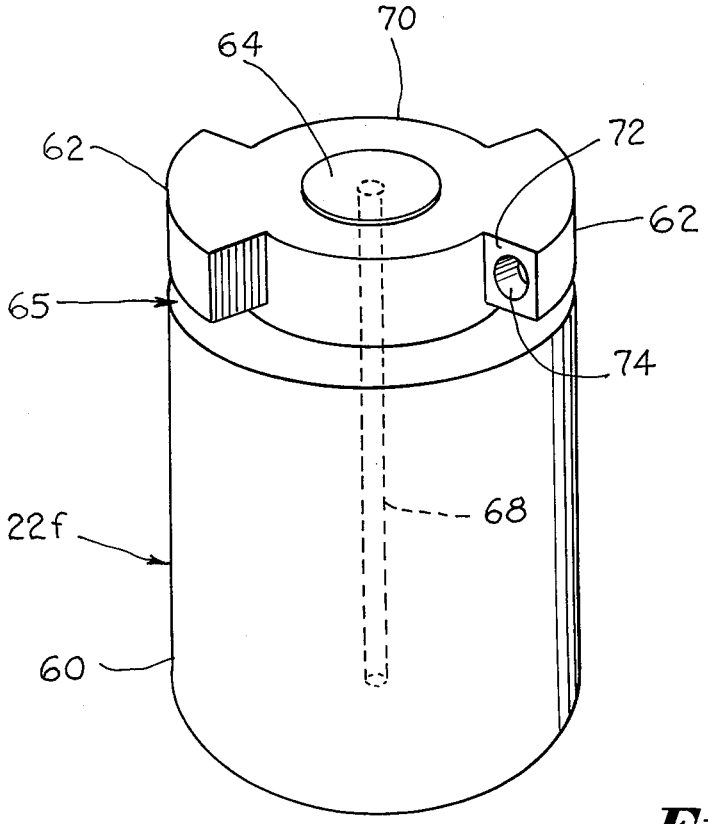
FIG. 21 is a perspective view of still another package suitable for use in the machine of FIG. 10 equipped with a receptacle as illustrated in FIG. 22.

Still another syrup package that can be utilized in the dispenser of FIG. 10 is illustrated in FIG. 21.

The package as shown in FIG. 21 comprises a blow-molded plastics container having a body 60 provided at the top end thereof with two projections or lugs 62. The top of the container is sealed by means of a disk 64 of plastics material to the underside of which is a dip tube 68 which extends from the top of the container to a location near the bottom thereof. The container is generally circular and the dip tube 68 lies on the axis thereof, referred to herein as the longitudinal axis, and there is provided to the underside of the projection 62, which are diametrically opposite and are identical, a groove 65. The projections 62 project from a reduced diameter section 70 of the container, and each projection 62 is provided on an end face 72 thereof, with a conical recess 74 for a purpose to be explained.

Figure 22:
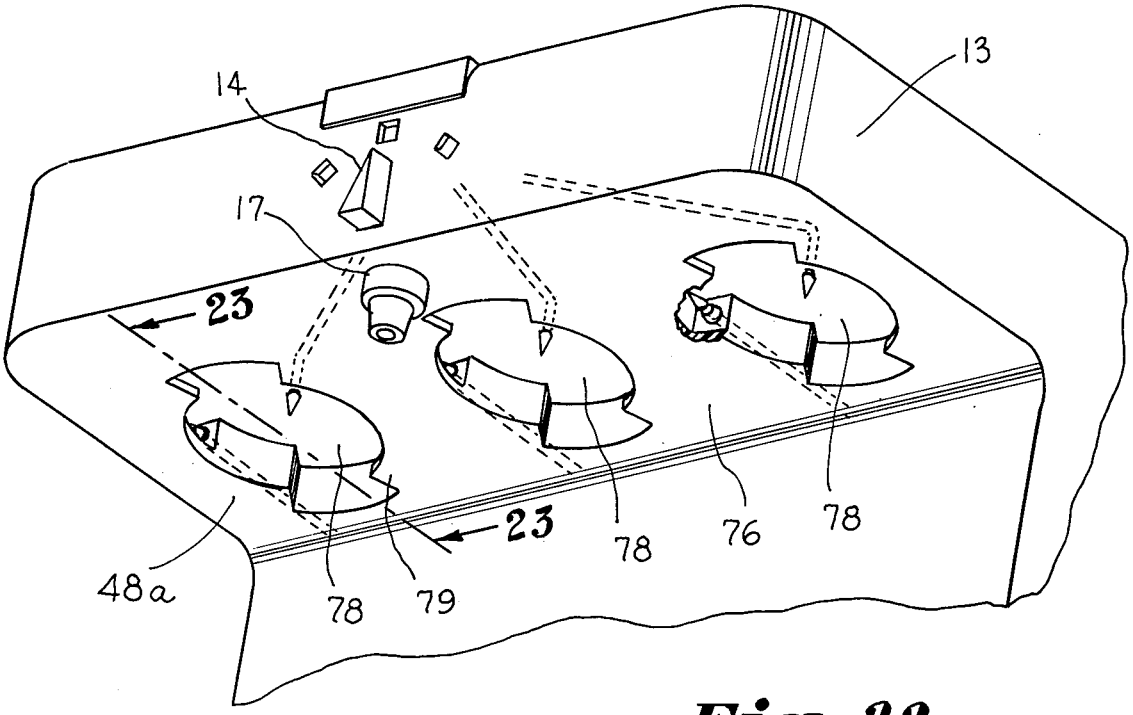
FIG. 22 is a composite perspective view showing the under surface of a portion of the machine shown in FIG. 10, provided to receive a package such as illustrated in FIG. 21.

Reference is now made to FIG. 22, this figure shows the underside of the front end of the machine top panel 13. The underside of the front end of the top panel 13 is defined by a lower surface 76 which is provided with three apertures 78 of the same shape as defined by the profile at the top end of the package of FIG. 21. That is to say, each aperture 78 has two low portions and a reduced diameter portion from the low portions project to correspond to the shape defined in plan by the projections 62 and the reduced diameter portion 70 of the top end of the container, so that a container can fit in the said aperture in only one of two dispositions, which relative to the longitudinal axis of the container are displaced by 180 degrees.

Figure 23:
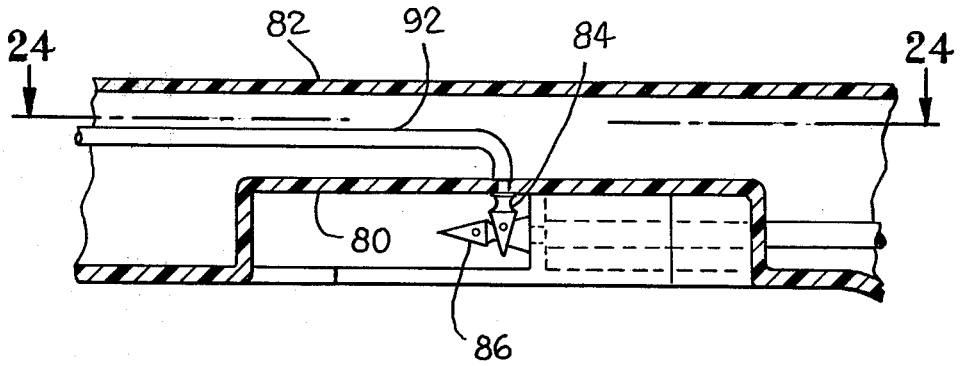
FIG. 23 is a sectional view taken along line 11—11 in FIG. 10 utilizing a receptacle such as illustrated in FIG. 22.
Figure 24:
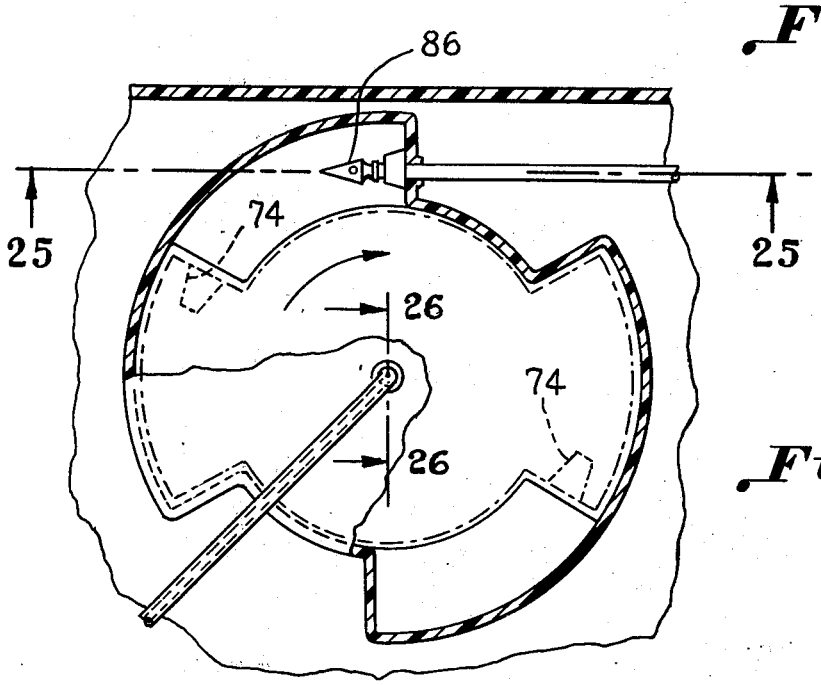
FIG. 24 is a sectional view taken along line 24—24 of FIG. 23, FIGS. 25 and 26, respectively, are sectional elevations of details of the arrangement shown in FIG. 24, the sections respectively being taken on the lines 25—25, and 26—26 shown in FIG. 24, FIGS. 27 and 28, respectively, are perspective views of alternative forms of package constructions.
Figure 25:
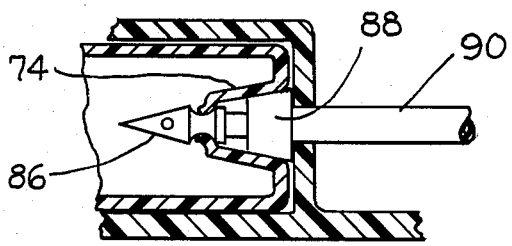
Figure 26:
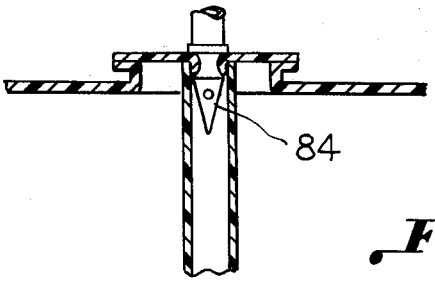

If reference is now made to FIGS. 23 and 24, it will be seen that additionally the front end of the top panel 13 is defined also by an intermediate plate 80 and a top plate 82. The spacing between the intermediate plate 80 and the bottom plate 76 corresponds to the height of the projections 62 in a longitudinal direction of the container, so that when a container is inserted through an aperture 78, it can be twisted or rotated about the longitudinal axis container, so that the projections 62 engage behind the small diameter portions of aperture 78 defined by the plate portions 79, which serve to hold the container in suspended fashion. Inside the space between the plate 80 and the plate 79, for each container, are two piercing spikes 84 and 86. The spike 84 is located so as to pierce the container in the top disk 64 and to engage in the dip tube 68 as shown more particularly in FIG. 26. The spike is such that in piercing the plastics material of the disk 64 there is formed a seal at a neck in the spike 84 between the plastics material of the disk 64 and said spike neck. The spike 84 enters the container as described when the container is first inserted through the slot 78. To complete the connection the container is then twisted so that the portions 79 of the plate 76 engage in the groove 65 of the container and underneath the projections 62 whereby the container head is locked to the plate 76. The rotation is continued until the spike 86 enters the appropriate recess 74 and eventually the spike 86 pierces the bottom of the recess 74 as shown clear in FIG. 25. The neck of the spike 86 sealingly engages the plastics material of the container, but additionally the spike 86 is asserted with a conical sealing washer 88 which engages the wall of the said recess 74 to effect the seal between the washer and recess wall. The spike 86 is connected to a pipe 90 carrying the carbon dioxide gas under pressure so that said gas can be introduced into the container to drive liquid therefrom up the dip tube and out through the spike 84 to which is connected the syrup discharge line 92 which leads through the dispensing valve to the dispensing outlet 17.

The arrangement described provides a simple and effective means of establishing the spike connections and this is achieved by appropriate container design. When container 22*f* is empty it is removed from the machine simply by twisting the container in the opposite direction so as to retract the spike 86 and then by pulling the container downwardly to remove the container from the spike 84. For the purposes of fitting and removing containers it may be desirable to raise the top 13 so that the operator can readily grip the containers for insertion and removal.

The design arrangement of the equipment illustrated in FIG. 10 provides several advantages, one being that the containers are visible to any person operating the machine and it will be easy for such person to select the correct flavor. Secondly, because the containers are visible the user will see immediately when any container requires replacement, and thirdly the containers can be clearly marked on the exterior indicating the flavor of syrup contained therein.

Figure 27:
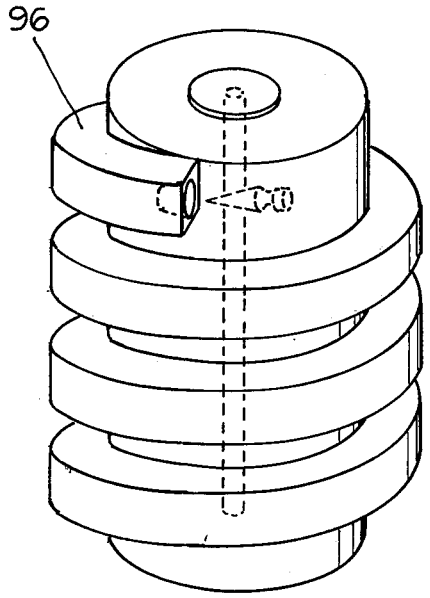
Figure 28:
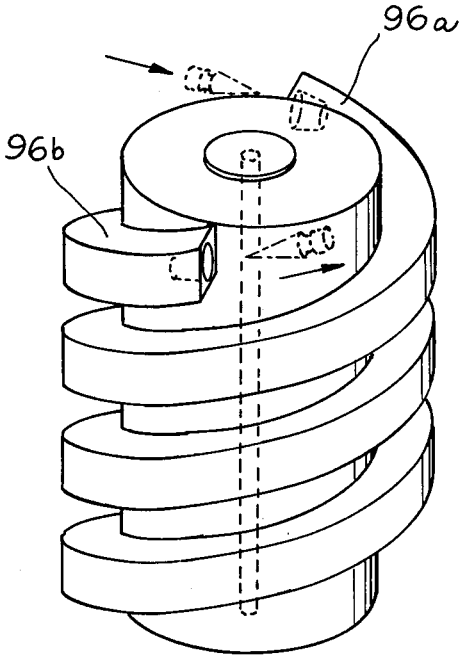

It is possible to achieve the same effect by designing the container in a different manner. Thus, in FIGS. 27 and 29 two alternative container constructions are shown. In FIG. 27 the projection which is pierced by the carbon dioxide spike is defined by a helical thread 96 which also serves for the screwing of the container in the machine. The machine would be required to be provided with a suitable receptacle having a corresponding internal groove. In the arrangement of FIG. 28 two projections are provided by a double start thread 96*a* and 96*b*, one projection being provided for piercing by the carbon dioxide pin and the other projection being provided for piercing by the syrup pin. In the arrangement shown in FIG. 28, the thread which is pierced by the syrup pin is also required to act as a dip tube or be provided internally with a dip tube so that the syrup will be forced up the interior of the thread or tube and be discharged from the container through the syrup spike.

The advantage of the arrangement described is that the piercing pins are located in portions of the machine to be out of the way so that it will not be possible easily for a child or other person to impale their fingers on such spikes.

Figure 29:
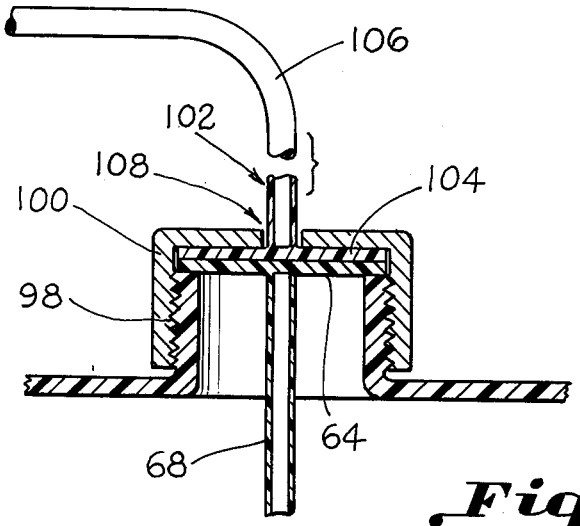
FIG. 29 is a sectional elevation showing an alternative method of connecting a syrup outlet pipe to a package.

In the arrangement shown in FIG. 29, a modified construction for providing the syrup outlet is shown. In this case the container is provided with a threaded neck portion 98 and a cap 100 which is screwed to the neck portion. Additionally, there is a second cap which includes tube element 102 and disk 104. Positioned therebelow is a disk 64 and a tube 68 already described. The cap 100 is provided with a central aperture 108. The tube 106 leads to the dispensing valve and the tube itself can form a valve element in that it can be pinched by suitable mechanism to provide a flow of syrup therefrom except that the valve is operated when the pinching effect is removed. The disk 104 is arranged back to back with the disk 64 and is held sealingly thereto by the cap 100 and the tube 106 projected through the aperture 108 is shown. To establish fluid connection between the tube 68 and tube 106 the user penetrates each of disks 64 and 104 centrally with a suitable piercing tool. The advantage of this arrangement is that when the container is empty everything can be thrown away and the machine user will not have the problem of cleaning syrup lines which will be the case when the syrup lines extending between the containers and the dispensing valve are permanent fixtures. In the embodiment of FIG. 29, the package is of course, still constructed with a projection to form a connection point by spike for the supply of gas under pressure.

While a preferred embodiment of the invention has been described using specific terms, such description is for illustrative purposes only, and it is to be understood that changes and variations may be made without departing from the spirit or scope of the following claims.

What is claimed is:

1. Carbonated liquid dispensing apparatus of the type which includes a liquid container, a rigid receptacle to removably receive the liquid container, and a piercing device carried by said receptacle for piercing said liquid container when inserted in said receptacle in an operating position, said apparatus comprising:

an outwardly protruding profiled lobe portion carried by said liquid container;

said lobe portion having a penetratable wall portion;

a hollow cavity portion defined within the interior of said profiled lobe for accommodating said piercing device;

arcuate guide means formed in said receptacle for receiving said lobe portion and guiding said lobe portion to said piercing device as said lobe is rotated therein;

opening means formed in said receptacle accommodating the shape of said profiled lobe portion affording access of said lobe portion to said arcuate guide means;

whereby said liquid container may be received in said receptacle and rotated to cause said lobe portion to be guided and pierced by said piercing device and be properly connected in said operating position.

2. The apparatus of claim 1 including a second outwardly protruding profiled lobe portion carried at an upper portion of said liquid container having a shape different than said first mentioned profiled lobe portion, said opening means including a pair of profiled openings corresponding in shape to respective ones of said first and second profiled lobe portions whereby said lobe portions have access to said arcuate guide means only in a predetermined manner.

3. The apparatus of claim 1 including a central penetratable indenture portion formed in said liquid container aligned with said other piercing device for being pierced thereby when inserted in said receptacle in said operating position.

4. The apparatus of claim 1 wherein said opening means is formed in a top rim of said receptacle affording access through the top of said receptacle.

5. A receiver and syrup container for use in a beverage dispensing device comprising:

a receptacle;

an arcuate channel carried adjacent a top portion of said receptacle;

a socket provided in said arcuate channel;

a piercing pin carried in said socket;

a sealed syrup container including (i) at least one hollow lateral protuberance carried by said container communicating with the interior of said container having a penetratable wall portion;

(ii) said lateral protuberance being of sufficient size to be inserted into said arcuate channel and guided into said socket;

(iii) said lateral protuberance extending into said socket serving as a suspension means for aiding in supporting said container in suspended position in said receptacle, and said piercing pin extending through said penetratable wall portion of said protuberance providing communication with the interior of said container.

6. The beverage dispensing device as set forth in claim 5 further comprising:

a vertically extending slot provided in said receptacle and extending into said arcuate channel;

said slot provided for receiving said protuberance and acting as a guide when inserting said container in and removing said container from said receptacle.

7. The beverage dispensing device as set forth in claim 5 further comprising:

a second socket provided in said arcuate channel;

a piercing pin carried in said second socket;

a second lateral protuberance carried by said container in opposed relation to said first mentioned lateral protuberance;

said second lateral protuberance extending into said second socket serving as a suspension means for aiding in supporting said container in suspended position, and said piercing pin carried in said second socket extending into said second lateral protuberance providing communication with the interior of said container.

8. A sealed liquid container for connection to a receptacle having two arcuate slots, a piercing device carried in each slot, a propellant gas supply being connected to one of said piercing devices and a liquid discharge outlet connected to said other piercing device, said container comprising:

a top wall, a bottom wall, a side wall connecting said top and bottom walls, said walls defining a container interior;

two hollow projections whose interiors are in fluid communication with the interior of the container and which extend outwardly from said container wall above said bottom wall for location in said arcuate slots to provide a connection between said receptacle and said container;

means defining a liquid flow passage from the interior of one of said projections to establish said fluid communication with the interior of the container at the bottom region thereof; and said projections being of penetratable material to enable said projections to be impaled on said piercing devices upon being inserted in said slots.

9. A sealed liquid container for connection to a receptacle having two arcuate slots, a piercing device carried in each slot, a propellant gas supply being connected to one of said piercing devices and a liquid discharge outlet connected to said other piercing device, said container comprising:

a top end wall, a bottom end wall, a side wall connecting said top and bottom end walls, said walls defining a container interior;

two hollow projections whose interiors are in fluid communication with the interior of the container and which extend outwardly from said container wall adjacent an end wall for location in said arcuate slots to provide a connection between said receptacle and said container; and said projections being of penetratable material to enable said projections to be impaled on said piercing devices upon being inserted in said slots.

* * * * *